United States Patent [19]

Haderer et al.

[11] 4,027,121

[45] May 31, 1977

[54] YARN TRAPPER FOR YARN DETECTOR SWITCH

[75] Inventors: Edward G. Haderer, Newtown Square, Pa.; Edward J. Sawoski, Blackwood, N.J.; Robert E. Shanebrook, Norwood, Pa.

[73] Assignee: Cutler-Hammer, Inc., Milwaukee, Wis.

[22] Filed: Oct. 10, 1975

[21] Appl. No.: 621,548

[52] U.S. Cl. ..... 200/61.13; 28/51; 57/81; 66/163; 200/61.18

[51] Int. Cl.[2] ..... B65H 25/14; D04B 35/14

[58] Field of Search ..... 28/15, 51, 71.4; 57/81, 57/86, 87, 106, 107, 108, 80; 66/125 R, 146, 160–163; 200/61.13, 61.14, 61.18; 226/91, 92; 242/147 R, 154 R

[56] References Cited

UNITED STATES PATENTS

| | | | |
|---|---|---|---|
| 2,706,883 | 4/1955 | Keen | 57/107 X |
| 3,194,001 | 7/1965 | Forward | 57/87 |
| 3,707,854 | 1/1973 | Matzel | 66/163 X |
| 3,772,487 | 11/1973 | Levin | 200/61.18 X |
| 3,806,677 | 4/1974 | Dehiega et al. | 200/61.13 |
| 3,848,434 | 11/1974 | Hopkins | 200/61.13 X |

*Primary Examiner*—James R. Scott
*Attorney, Agent, or Firm*—Hugh R. Rather; William A. Autio; Michael E. Taken

[57] ABSTRACT

A trapper for trapping the yarn in a knitting machine and holding it, under normal slackening when knitting certain patterns, to prevent unwanted tripping of the detector switch and machine shutdown. This yarn trapper consists of a one-piece wire member having a two-turn helix with a pair of supporting arms bent out radially and outwardly from opposite ends thereof at a common angular point on the periphery of the helix and having inwardly bent mounting hooks at their ends. These arms are held slightly spread apart from their normal relaxed condition when the trapper is snap-mounted on the yarn detector switch to relieve the pressure between each of the half-turns and the full turn and thus provide a pair of semi-circular traps formed by the half turns in light touching contact with different portions of the full turn to frictionally hold even the thinnest yarn if it should be pulled thereinto upon attempted swinging of the trip lever. This trapping prevents full swinging of the trip lever and thus prevents unnecessary shutdown of the machine.

7 Claims, 4 Drawing Figures

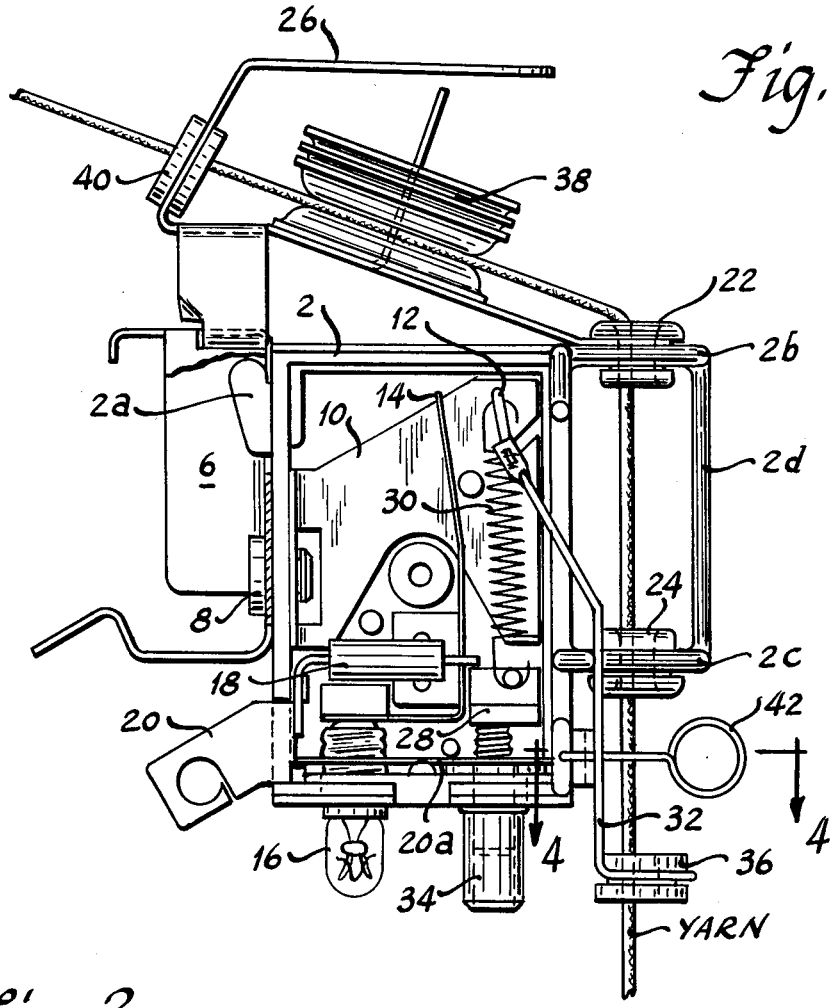
Fig. 1
Fig. 2
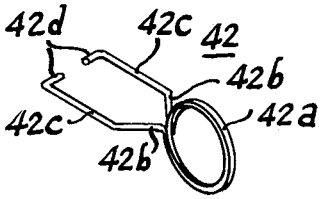
Fig. 3
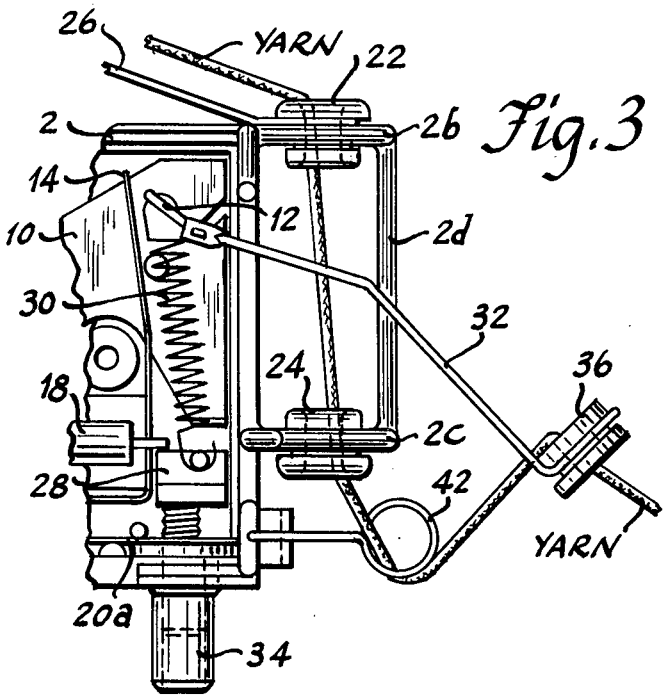
Fig. 4
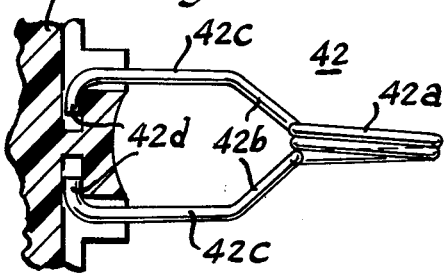

YARN TRAPPER FOR YARN DETECTOR SWITCH

BACKGROUND OF THE INVENTION

Yarn trappers for use with lower yarn detector switches have been known heretofore. For example, A. W. Hopkins U.S. Pat. No. 3,848,434, dated Nov. 19, 1974, owned by the Assignee of this invention, shows a yarn trapper of the bent-back wire type with these bent-back portions being closely spaced to trap the yarn guided thereinto by the formed V-shaped cleft to frictionally hold the yarn when it is pulled thereinto upon attempted swinging of the trip lever.

While such prior known trapper has been useful for its intended purpose, it has at times failed to catch and hold the yarn thereby allowing unnecessary shutdown of the knitting machine. This is due to the difficulty of forming the bent-back wire portions accurately in manufacture. This invention relates to improvements thereover.

SUMMARY OF THE INVENTION

An object of the invention is to provide an improved yarn trapper.

A more specific object of the invention is to provide an improved yarn trapper that is more reliable and effective in performing its function.

Another specific object of the invention is to provide an improved yarn trapper that is easy and economical to manufacture.

Another specific object of the invention is to provide an improved yarn trapper that simplifies close tolerance manufacture.

Other objects and advantages of the invention will hereinafter appear.

BRIEF DESCRIPTION OF THE DRAWINGS

FIG. 1 shows a front elevational view of a lower yarn detector switch in its normal untripped condition and a yarn trapper mounted thereon;

FIG. 2 is an isometric view of the yarn trapper;

FIG. 3 is a fragmentary front elevational view of the lower yarn detector switch showing the yarn trapped to prevent tripping of the switch; and FIG. 4 is a partial sectional view taken along line 4—4 of FIG. 1 to show a top view of the yarn trapper.

DESCRIPTION OF THE PREFERRED EMBODIMENT

Referring to FIG. 1, there is shown a "lower" yarn detector switch generally similar to that disclosed in the aforementioned A. W. Hopkins patent and described in more detail therein except for the yarn trapper mounted thereon. "Lower" refers to the fact that this switch is positioned near the point where the yarn enters the knitting elements of the machine. Thus, this switch, upon tripping should the yarn break, is able to stop the machine before the end of the broken yarn enters the knitting needles.

In the textile industry, on knitting machinery, a trapper is usually furnished with the lower yarn detector switch. When knitting certain patterns, such as stripes on striper machines, certain yarns will not be fed during portions of the knitting of the particular pattern and thus these yarns will go slightly slack. As a yarn goes slack, the trapper functions to catch and hold the yarn, keeping it taut in the switch area, and therefore preventing the switch from tripping the machine off. If the trapper does not function properly it will allow unwanted stoppage of the machine.

As shown in FIG. 1, the lower yarn detector switch is provided with an insulating housing 2, including a front cover, not shown, that snaps on to close the housing. A mounting bracket 6 is secured to the left side of the housing for snap-in mounting of the switch to a horizontally running strip or bar, such mounting bracket or clip also serving as one terminal, negative or ground, of the electric circuit therein. This electric circuit extends from its negative terminal or ground at mounting bracket 6 through a fastener post 8 and a bracket plate 10 to crank shaft 12 which is the movable contact of the switch. This circuit then continues from contact plate 14 which is the resilient stationary contact of the switch through lamp bulb 16 and resistor 18 in parallel to its prositive terminal at lamp terminal plate 20. Housing 2 is provided with an integrally-molded mounting hook 2*a* for supporting bracket 6.

Housing 2 is also provided with stationary yarn guiding means including integrally-molded upper and lower, parallel eyelet supports 2*b* and 2*c* extending laterally from the right wall thereof and connected by an integral vertical bar 2*d* for rigidity. These supports are provided with means for snap-in mounting of ceramic eyelets 22 and 24, respectively. Upper eyelet 22 secures the divided end of a thread tension guide bracket 26 hereinafter described.

The housing contains an adjusting screw 28 for varying the tension in a helical tension spring 30 connected between this screw and crank shaft 12 which is mounted between bracket plate 10 and the front cover. This crank shaft is provided with flat portions at its externally projecting ends for nonrotatably retaining trip lever 32.

The threaded shaft of adjusting screw 28 extends down into a tapped hole in an axially fixed but rotatable adjusting nut 34 that extends out through a hole in the lower wall of the housing to be accessible for manual adjustment of the spring tension. This nut has a flange on its upper end that is confined against the lower wall of the housing by the right-hand portion 20*a* of lamp terminal plate 20.

Trip lever 32 is a generally U-shaped wire member having its ends slotted for snap-in engagement with the external ends of crank shaft 12. This assembly holds the trip lever rigidly to the crank shaft so that the trip lever will allowed the tension spring to rotate the crank shaft to close the contacts when the yarn breaks. The lower portion of the trip lever is vertical as shown in FIG. 1 and its lower end is bent at a right angle toward the right and formed to retain a ceramic eyelet 36, this eyelet being in vertical alignment with eyelets 22 and 24 in operative position of the trip lever as shown in FIG. 1.

Thread tension bracket 26 is secured to eyelet 22 and mounting bracket 6. This thread tension bracket is formed to retain a stack of tension washers 38 between which the yarn runs and a ceramic eyelet 40 through which the yarn passes toward washers 38 and then to yarn guiding eyelet 22.

The yarn detector switch is provided with the aforementioned improved yarn trapper 42 formed from round metal wire such as stainless steel spring wire or the like. As shown in FIGS. 2 and 4, this trapper is provided with a helix 42*a* of two full turns with the ends of the wire bent at 42*b* to diverge laterally to form a V-shaped guide for the yarn and then bent parallel to one another at 42*c* with the extreme tips 42*d* being bent toward one another on a common axis so that they can be biased apart and allowed to snap into holes, and grooves leading horizontally to the right therefrom, on opposite sides of the lower right-hand corner of the housing. As shown in FIG. 1, the supporting ends of this wire extend from the opposite ends of this two-turn helix at the same angular point and in a common radial plane. As shown in FIG. 4, these supporting ends of this wire are bent at diverging angles of about 40 degrees outwardly from the central vertical plane or at angles suitable to lead the yarn into the helix. The remaining portions of these supporting ends of the wire, except the extreme tips, are parallel to one another and are spaced apart a suitable distance relative to the thickness of the housing so that, when the trapper is mounted on the housing, these supporting ends or arms are sprung apart to loosen the left side of the helix enough to receive and trap the yarn as shown in FIG. 3.

As will be apparent from the foregoing, this trapper provides longer, precisely formed traps closer to the yarn for receiving and securely holding the yarn. Thus, there are provided two traps, one on each side of the central full turn of the helix. Each such trap is semi-circular in shape. The front trap extends in a semi-circle below the level of the arms and the rear one extends in a semi-circle above the level of the arms. This semi-circular shape provides a longer trap in the available horizontal distance and thereby effects more efficient trapping of the yarn. Moreover, two traps are provided so that the yarn may enter either one and is securely held therein. The helix can be easily formed, thus avoiding close tolerance manufacturing problems.

FIG. 3 shows operativeness of the trapper. When the yarn becomes slack but not loose enough to require tripping of the machine for stop-motion purposes, trip lever 32 swings partly out and draws the yarn into one of the traps in the helix of the trapper. This takes up the slack in the yarn. This slack is not enough to allow full swinging of the trip lever and contacts 12 and 14 remain open as shown in FIG. 3. When drawing of the yarn into the knitting machine is resumed, trip lever 32 swings back to the position shown in FIG. 1 and the yarn becomes released from the trapper.

While the apparatus hereinbefore described is effectively adapted to fulfill the objects stated, it is to be understood that the invention is not intended to be confined to the particular preferred embodiment of yarn trapper for yarn detector switch disclosed, inasmuch as it is susceptible of various modifications without departing from the scope of the appended claims.

We claim:

1. In a yarn detector device having a housing including yarn guiding means, a detector mechanism in the housing including a spring-biased switch, a trip lever on the outside of the housing coupled to said spring-biased switch and biased thereby in one pivotal direction affording closure of the switch and having an eyelet through which the yarn passes and when taut holds it in its opposite pivotal direction maintaining the switch open, the improvement comprising:

a yarn trapper mounted on said housing and comprising:

a helix and supporting means therefor causing one side its turns to be spread slightly apart to form yarn traps;

said supporting means comprising a pair of spaced supporting arms extending from opposite ends of said helix on opposite sides of the yarn to guide said yarn toward said spread apart turns as it is approaching the eyelet of said trip lever;

and snap-in means mounting the ends of said arms to said housing to confine said yarn between said housing and said arms and the corresponding side of said helix that provides said traps between the turns to catch the yarn upon partial swinging of said trip lever due to slackness in the yarn thereby to prevent unwanted tripping.

2. The yarn trapper defined in claim 1 wherein:

said helix comprises two full turns with said supporting arms extending from opposite ends thereof at the same angular position.

3. The yarn trapper defined in claim 1, wherein:

said helix has a horizontal axis;

said supporting arms diverge from opposite ends of said helix in a horizontal plane at angles facilitating guiding of the yarn into said helix and then extend parallel to one another on opposite sides of the yarn to the housing with their tips bent toward one another on a common axis.

4. The yarn trapper defined in claim 3, wherein:

said mounting means comprises holes on opposite sides of the housing for receiving the tips of said supporting arms, and grooves extending from said holes to the edge of the housing for supporting said arms horizontally.

5. The yarn trapper defined in claim 1, wherein:

said helix comprises two full turns with said supporting arms extending divergingly from opposite ends thereof in a horizontal plane common to the plane of the axis of said helix;

and said arms are sprung apart when mounted sufficiently to relieve the pressure between the half-turn on each end of the helix and the central full turn thereby to provide a pair of semi-circular traps, one above and one below the level of the arms, for catching the yarn.

6. The yarn trapper defined in claim 1, wherein:

said helix and supporting arms are formed integrally from a length of stainless steel wire.

7. The yarn trapper defined in claim 1, wherein:

said helix and supporting arms are formed from a single piece of spring wire.

* * * * *

UNITED STATES PATENT AND TRADEMARK OFFICE

CERTIFICATE OF CORRECTION

PATENT NO. : 4,027,121

DATED : May 31, 1977

INVENTOR(S) : Edward G. Haderer, Edward J. Sawoski, Robert E. Shanebrook

It is certified that error appears in the above-identified patent and that said Letters Patent are hereby corrected as shown below:

ABSTRACT

Line 1 through line 4, "A trapper for trapping the yarn in a knitting machine and holding it, under normal slackening when knitting certain patterns, to prevent unwanted tripping of the detector switch and machine shutdown." should be deleted.

Line 6 through line 8, beginning "bent out radially and outwardly from opposite ends thereof at a common angular point on the periphery of the helix" should be deleted.

Line 6, after arms insert -- for guiding the yarn --.

Line 12 through line 14, beginning "relieve the pressure between each of the half-turns and the full turn and thus" should be deleted.

Line 18 through line 20, "This trapping prevents full swinging of the trip lever and thus prevents unnecessary shutdown of the machine." should be deleted.

Column 4, line 8, insert "of" after -- side --.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*